US006948986B2

(12) United States Patent
Kojima et al.

(10) Patent No.: US 6,948,986 B2
(45) Date of Patent: Sep. 27, 2005

(54) CONNECTOR

(75) Inventors: Eiji Kojima, Yokkaichi (JP); Keigo Atsumi, Yokkaichi (JP); Atsushi Nishida, Toyota (JP); Masato Minakata, Toyota (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/875,392

(22) Filed: Jun. 24, 2004

(65) Prior Publication Data

US 2005/0009412 A1 Jan. 13, 2005

(30) Foreign Application Priority Data

Jun. 27, 2003 (JP) ..... 2003-184221

(51) Int. Cl.[7] ..... H01R 13/514
(52) U.S. Cl. ..... 439/752; 439/595
(58) Field of Search ..... 439/595, 752

(56) References Cited

U.S. PATENT DOCUMENTS 5,336,540 A 8/1994 Kato et al.
5,628,652 A * 5/1997 Ohsumi ..... 439/595
5,672,075 A * 9/1997 Maejima ..... 439/595
6,328,614 B1 * 12/2001 Osawa ..... 439/752
6,361,379 B1 * 3/2002 Ito et al. ..... 439/752

* cited by examiner

*Primary Examiner*—Briggitte R. Hammond
(74) *Attorney, Agent, or Firm*—Gerald E. Hespos; Anthony J. Casella

(57) ABSTRACT

A housing (30) has cavities (31) for receiving terminal fittings (10), and a lock (33) is provided in each cavity (31). The terminal fitting (10) temporarily resiliently deforms the lock (33) when the terminal fitting (10) is inserted into the cavity (31). The lock (33) then is restored resiliently to engage the terminal fitting (10) when the terminal fitting (10) reaches a proper depth. An outer wall (17) of the terminal fitting (10) facing the lock (33) has a locking projection (27) projecting toward and engageable with the lock (33). A recess (54) is formed in a surface of the lock (33) that slides in contact with the locking projection (27) in an inserting process. An arcuate surface (29*a*) of the locking projection (27) and a bottom surface (54*a*) of the recess (54) have substantially conforming shapes.

11 Claims, 10 Drawing Sheets

CONNECTOR

BACKGROUND OF THE INVENTION

1. Field of the Invention

The present invention relates to a connector.

2. Description of the Related Art

U.S. Pat. No. 5,336,540 relates to a connector with a housing formed with cavities for receiving terminal fittings. Resiliently deformable locks are formed with the housing and project into the cavities. The locks are deformed as the terminal fittings are inserted into the cavities. However, the locks are restored resiliently when the terminal fitting reaches a proper depth. The restored locks engage an engaging portion of the terminal fitting, and thereby prevent the terminal fitting from coming out.

Locking forces on the terminal fittings may be insufficient if the locks are made smaller in an effort to miniaturize the connector. Locking forces can be enhanced by forming each terminal fitting with a projection that projects towards the lock. The lock engages both the engaging portion and projection, thereby enhancing a locking force. However, this design increases an inserting force because the lock must be deformed by an additional amount dictated by the projecting distance of the projection.

The invention was developed in view of the above problem and an object is to reduce the deformation of a lock during insertion of a terminal fitting.

SUMMARY OF THE INVENTION

The invention relates to a connector with a housing that has a cavity. A resiliently deformable lock is formed in the cavity and is deformed as a terminal fitting is inserted into the cavity. The lock is restored resiliently and engages the terminal fitting when the terminal fitting reaches a proper depth, thereby preventing the terminal fitting from coming out. An outer wall of the terminal fitting facing the lock has a locking projection that projects towards and engages the lock. A recess is formed in a surface of the lock that slidably contacts the locking projection. The sliding-contact surfaces of the locking projection and the recess have substantially conforming shapes.

The lock engages the locking projection when the terminal fitting is inserted to the proper depth in the cavity. Thus, the terminal fitting can be held with a sufficient locking force.

A degree of resilient deformation of the lock during insertion of the terminal fitting is made smaller by the depth of the recess. As a result, an inserting force for the terminal fitting is reduced. Further, the deformation of the lock can be reduced maximally since the sliding-contact surfaces of the locking projection and the recess have substantially conforming shapes.

The locking projection preferably comprises a slanted front portion that is substantially semiconical.

The locking projection preferably has a rear surface configured for sliding contact with a bottom surface of the recess over substantially the entire width, so that almost no clearance is defined between the two surfaces.

The lock preferably has an arm that is resiliently deformable about at least about one end. The arm preferably is substantially as wide as the cavity.

The lock preferably is substantially transversely symmetrical when viewed from front.

At least one excessive deformation preventing portion may be provided for engaging the lock before the lock is deformed beyond its resiliency limit to prevent excessive deformation of the lock.

The lock preferably comprises a fastening projection for engaging and locking the terminal fitting. The fastening projection may comprise a locking surface that is inclined to overhang.

An operation groove preferably is formed in front of the lock for receiving the locking projection of the terminal fitting. An extended locking surface is formed at the rear end of the operation groove. The extended locking surface is substantially continuous with the locking surface of the lock and is engageable with the locking projection.

An engagement surface of the lock preferably overhangs and the extended locking surface is slanted with substantially the same inclination as the engagement surface.

The outer wall of the terminal fitting preferably is embossed in an intermediate position to form an outwardly projecting protrusion, and the cavity preferably has a protrusion insertion groove for receiving the protrusion.

The recess preferably is narrower than the protrusion insertion groove and/or substantially as wide as the locking projection. The depth of the recess may be less than about half, preferably about ⅓, of the depth of the protrusion insertion groove and/or the height of the locking projection.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A female connector according to the invention is described with reference to FIGS. 1 to 10. The connector is comprised of female terminal fittings 10, a housing 30 for accommodating the terminal fittings 10. In the following description, inserting and withdrawing directions of the terminal fittings 10 into the housing 30 are referred to as forward and backward directions, respectively.

Figure 4:
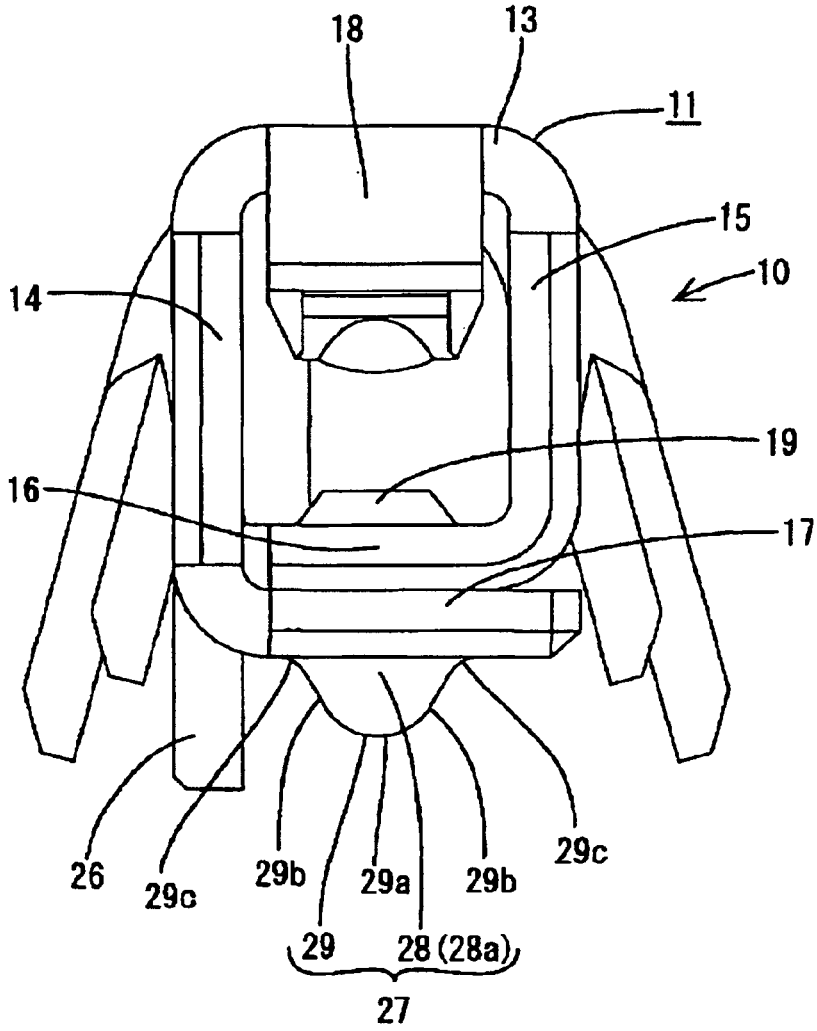
FIG. 4 is a front view of a terminal fitting.
Figure 5:
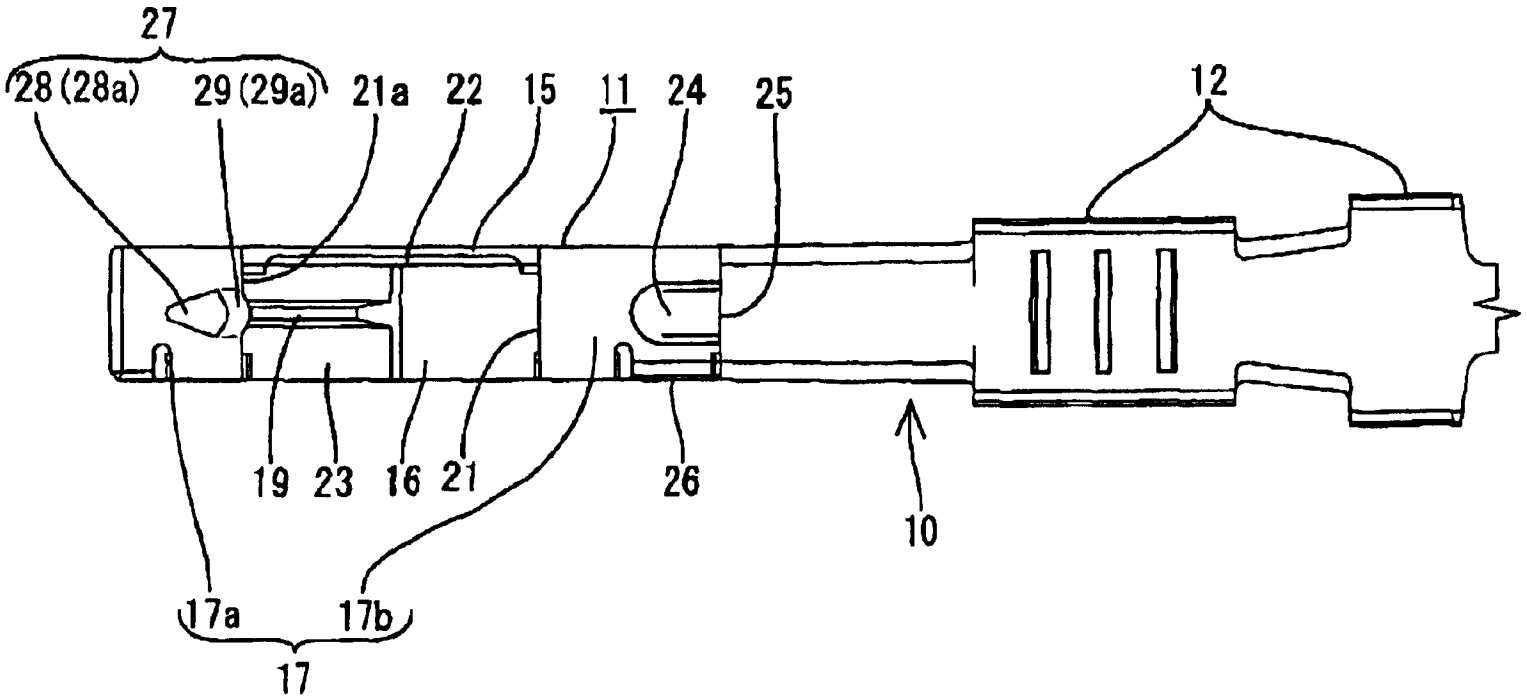
FIG. 5 is a bottom view of the terminal fitting.
Figure 6:
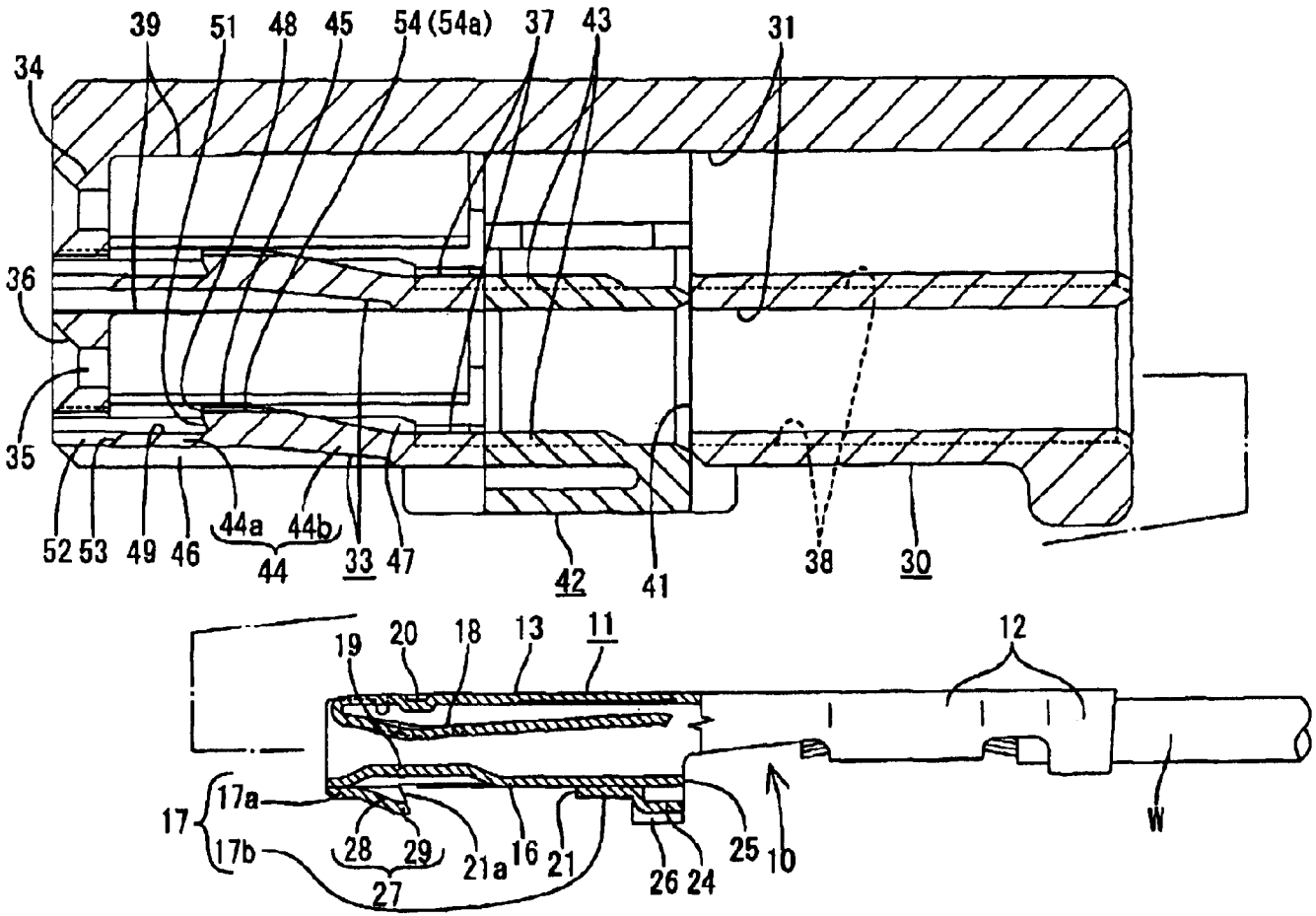
FIG. 6 is a side view in section showing a state before the terminal fitting is inserted into the housing and a retainer mounted at a partial locking position.

Each terminal fitting 10 has a specified shape and is formed by press-working a conductive metal plate. The terminal fitting 10 has a substantially box-shaped main portion 11 with open front and rear ends and a barrel 12 configured to be crimped, bent or folded into connection with the end of a wire W, as shown in FIGS. 4 to 6. The barrel 12 has a pair of front crimping pieces and a pair of rear crimping pieces to be crimped, bent or folded into connection with a core and an insulation coating of the wire W, respectively.

The main portion 11 includes a bottom wall 13 extending substantially along forward and backward directions. Sidewalls 14, 15 project up from opposite lateral edges of the bottom wall 13 and a ceiling wall 16 projects from the projecting end of the left side wall 14 of FIG. 4 to face the bottom wall. An outer wall 17 projects from the projecting end of the right side wall 15 of FIG. 4 and is placed at least partly on the outer side of the ceiling wall 16. The outer wall 17 of the main portion 11 faces down when the terminal fitting 10 is inserted into a cavity 31 of the housing 30.

The front end of the bottom wall 13 is more backward than the other walls 14, 15, 16, 17, and a resilient contact piece 18 is formed by folding back a tongue that projects from the front end of the bottom wall 13. The resilient contact piece 18 is cantilevered back and up at a moderate angle, and can resiliently contact a tab (not shown) of a mating male terminal fitting inserted into the main portion 11 from the front. The ceiling wall 16 has a receiving portion 19 that bulges in for squeezing the tab in cooperation with the resilient contact piece 18. The bottom wall 13 is embossed in to form an excessive deformation preventing projection 20 that engages the resilient contact piece 18 before the resilient contact piece 18 is deformed beyond its resiliency limit.

The outer wall 17 is divided into a front portion 17*a* and a rear portion 17*b* by forming a cut-away portion 21 substantially in the longitudinal middle over substantially the entire width. The cut-away portion 21 has an overhanging or undercut front cut end surface 21*a* inclined at an acute angle to the longitudinal axis of the terminal fitting 10 over its substantially entire area. This cut-away portion 21 is slightly shorter than half the length of the outer wall 17 and substantially extends up to the upper end of the sidewall 15 at the upper side of FIG. 5. A bulge 22 projects from the projecting end of the ceiling wall 16 and contacts the upper end surface of this sidewall 15 to support the ceiling wall 16 in a proper substantially horizontal posture. The bulge 22 forms a recess 23 in a front portion of the ceiling wall 16, excluding a contact portion of the bulge 22 with the sidewall 15, so that the front half is slightly lower than a rear half. The front portion 17*a* of the outer wall 17 is slightly shorter along forward and backward directions than the rear portion 17*b*.

The rear end of the rear portion 17*b* of the outer wall 17 is embossed outwardly in an intermediate position to form a protrusion 24. A step 25 is defined at the rear ends of the ceiling wall 16 and the rear portion 17*b* of the outer wall 17, including the protrusion 24. A stabilizer 26 projects from the projecting end of the rear portion 17*b* of the outer wall 17 and has a function of guiding the insertion of the terminal fitting 10.

The rear end of the front portion 17*a* of the outer wall 17 is embossed out at the front cut end 21*a* of the cut-away portion 21 to form a locking projection 27. The locking projection 27 has a substantially semiconical slanted front portion 28 and a substantially semicylindrical rounded rear portion 29 coupled to each other. The front portion 28 is slanted so that the width and height thereof gradually decrease towards the front end. Additionally, the front portion 28 has an arcuate outer surface 28*a* when viewed from the front or rear. The extreme front end of the front portion 28 is rounded slightly. The rear portion 29 has a substantially constant width and height. As shown in FIG. 4, an arcuate surface 29*a* is formed around about ⅓ of the outer surface of the rear portion 29 at the projecting end. Substantially straight slanted surfaces 29*b* are continuous with the opposite ends of the arcuate surface 29*a* and extend towards the base ends. Curved surfaces 29*c* extend concavely from the ends of the slanted surfaces 29*b* towards the outer surface of the outer wall 17. The rear end surface of the locking projection 27 is formed by the front cut end surface 21*a* of the cut-away portion 21 and is slanted at a similar inclination. The projecting height of the locking projection 27 substantially equals the projecting height of the protrusion 24.

The housing 30 is made e.g. of a synthetic resin, and cavities 31 are arranged substantially side by side along widthwise direction at upper and lower stages, as shown in FIGS. 1 to 3 and 6. The terminal fittings 10 are insertable into the cavities 31 from behind. Each terminal fitting 10 is locked in the cavity 31 by a resilient lock 33 provided at a bottom wall 32 of the cavity 31, and is supported at its front end by a front wall 34 of the housing 30. A tab insertion hole 35 is formed in the front wall 34 of the housing 30 to permit the tab of the mating male terminal fitting to enter the cavity 31, and a substantially conical guiding surface 36 is formed over substantially the entire periphery at the front edge tab insertion hole 35 to guide the entrance of the tab.

The bottom wall 32 of the cavity 31 has a rearwardly open protrusion insertion groove 37 for receiving the locking projection 27 and the protrusion 24 of the terminal fitting 10. The bottom wall 32 of the cavity 31 also has a rearwardly open stabilizer insertion groove 38 for receiving the stabilizer 26. The protrusion insertion groove 37 is substantially in the widthwise middle of the cavity 31, whereas the stabilizer insertion groove 38 is at the side of the protrusion insertion groove 37. The protrusion insertion groove 37 extends continuously to the lock 33, whereas the stabilizer insertion groove 38 ends slightly behind the lock 33. The protrusion insertion groove 37 is slightly wider than the locking projection 27 and the protrusion 24, and is slightly deeper than the projecting heights of the locking projection 27 and the protrusion 24.

A bulge 39 gradually bulges in over substantially the entire width at the front end of the upper surface each cavity 31 and substantially faces the lock 33. Thus, the front end of the terminal fitting 10 inserted into the cavity 31 is urged towards the lock 33 by the bulge 39, thereby increasing a depth of engagement of the lock 33. The rear peripheral edge of each cavity 31 is slanted over substantially the entire periphery for guiding the terminal fitting 10. However, a preventing portion 40 is formed at an upper-left position of the rear peripheral edge of each cavity 31 in FIG. 2 and extends substantially normal to the inserting and withdrawing directions of the terminal fitting 10. The stabilizer 26 contacts the preventing portion 40 when the terminal fitting 10 is oriented improperly (e.g. upside down) to prevent the insertion of the terminal fitting 10. A front half of each cavity 31 is formed to be narrower than a rear half thereof.

A retainer mount hole 41 is formed in the bottom surface of the housing 30 for receiving a retainer 42 that doubly locks the terminal fittings 10. This retainer mount hole 41 exposes intermediate portions of the respective cavities 31 to the outside. The retainer 42 includes fasteners 43 arranged at upper and lower stages corresponding to the respective cavities 31. The retainer is movable in the housing 30 between a partial locking position (see FIG. 6) where the respective fasteners 43 are retracted from the cavities 31 to permit the insertion and withdrawal of the terminal fittings 10 into and from the respective cavities 31 and a full locking position (see FIG. 10) where the respective fasteners 43 enter the cavities 31 to engage the terminal fittings 10. The retainer 42 can be held selectively at the partial locking position and the full locking position by an unillustrated holding means.

Figure 1:
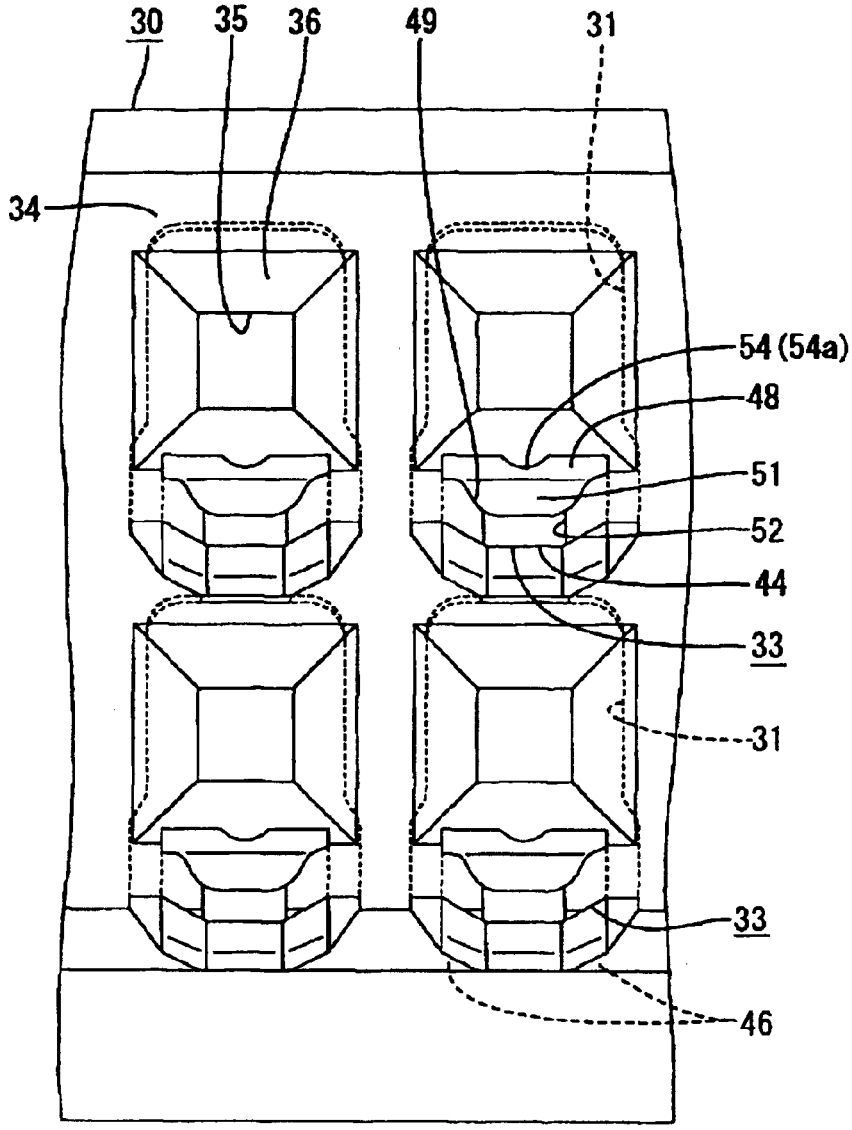
FIG. 1 is a front view of a housing according to the invention.
Figure 2:
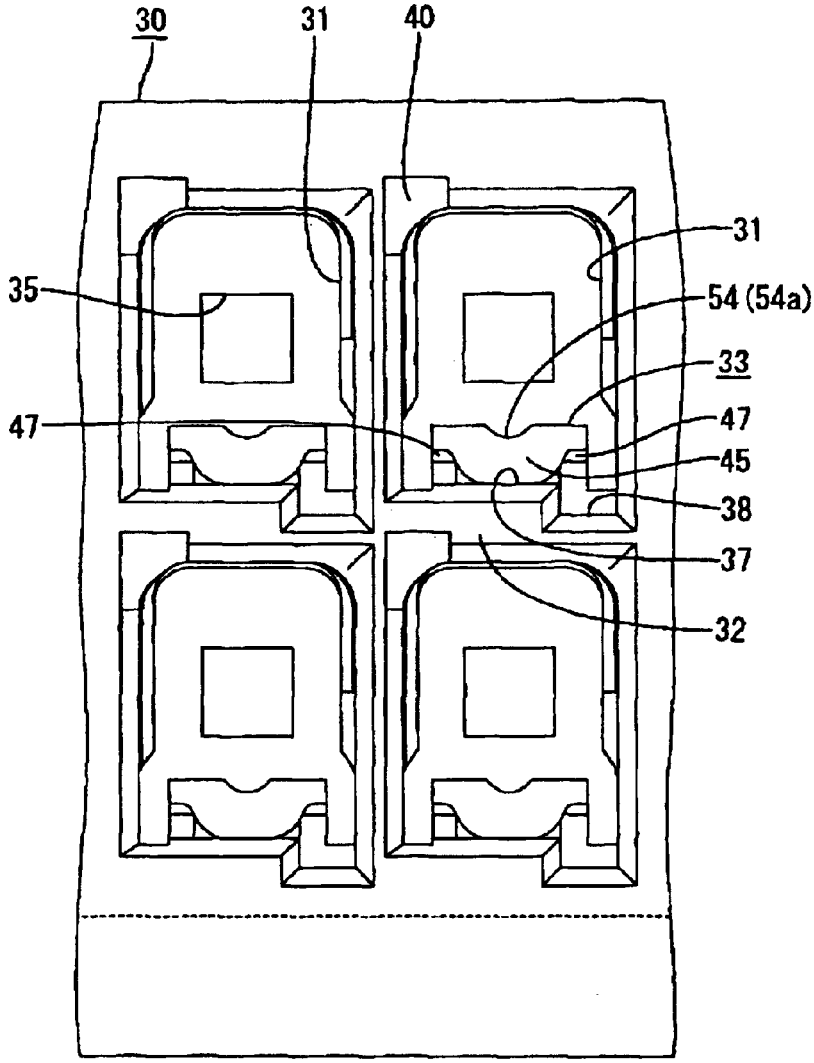
FIG. 2 is a rear view of the housing.
Figure 3:
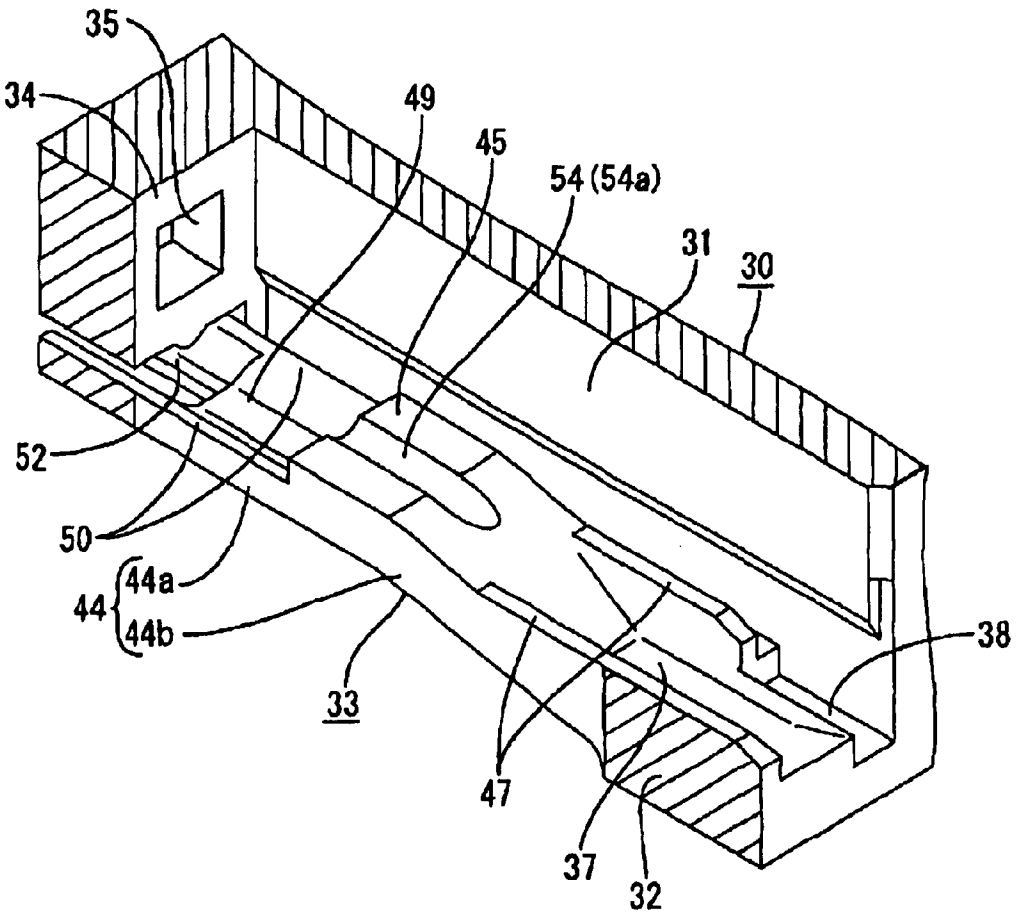
FIG. 3 is a perspective view partly in section of the housing.

As shown in FIGS. 3 and 6, each lock 33 is provided at a front side of the bottom wall 32 of the respective cavity 31 before and near the retainer mount hole 41. The lock 33 includes an arm 44 supported at both front and rear ends. A fastening projection 45 is formed on the upper surface of the arm 44 and projects into the cavity 31. The fastening projection 45 is configured to be inserted into the cut-away portion 21 of the terminal fitting 10 and to engage the front cut end surface 21*a*. The lock 33 is substantially transversely symmetrical when viewed from front. Additionally, the lock 33 at the upper stage serves as at least part of a partition wall between the adjacent cavities 31 at the upper and lower stages. The locks 33 at the lower stage also serve as the outer wall of the housing 30.

The arm 44 has a front view obtained by obliquely cutting off the opposite lower corners of a laterally long rectangle (see FIG. 1), and is slightly narrower than the cavity 31. The arm 44 is resiliently deformable substantially normal to the inserting and withdrawing direction, and has supports at both the front and rear ends. Thus, the arm 44 takes a substantially arch or bridge shape, with a longitudinal middle portion at a bottommost position during the deformation (see FIG. 7). A deformation space of a specified height is defined below the arm 44 in the deflection direction of the arm 44 for permitting the resilient deformation of the arm 44. Inwardly and downwardly sloped excessive deformation preventing portions 46 extend substantially along the longitudinal direction of the lock 33 at positions spaced out or down from the opposite sides of the arm 44, with the deformation space therebetween. The excessive deformation preventing portions 46 engage the lock 33 before the lock 33 is deformed beyond its resiliency limit. A rear portion 44*b* of the arm 44 is coupled to the bottom wall 32 over substantially the entire width and is sloped up and in towards the cavity 31 and towards the front. A front portion 44*a* of the arm 44 is coupled to the front wall 34 of the housing 30 and is substantially horizontal and parallel to the inserting and withdrawing directions. The protrusion insertion groove 37 in the bottom wall 32 is substantially continuous with the rear portion 44*b* of the arm 44 (FIG. 3), and portions of the bottom wall 32 at the opposite sides of the protrusion insertion groove 37 define rear supports 47 for supporting the terminal fitting 10 from below.

The fastening projection 45 has the same width as the arm 44, and has the front end thereof substantially aligned with the front end of the rear portion 44*b* of the arm 44. The rear surface of the fastening projection 45 is slanted and substantially continuous with the inclination of the rear portion 44*b* of the arm 44. A locking surface 48 is defined at the front of the fastening projection 45 for engaging the terminal fitting 10 and is substantially normal to the forward and backward directions.

A forwardly open operation groove 49 is formed in the upper surface of the front portion 44*a* of the arm 44 over the substantially entire length. The operation groove 49 can receive a disengagement jig (not shown) from the outside for forcibly deforming the lock 33. Portions of the upper surface of the arm 44 at opposite sides of the operation groove 49 define front supports 50 for supporting the terminal fitting 10 from below. Thus, the front portion 44*a* of the arm 44 is thinner than the rear portion 44*b* due to the operation groove 49. The operation groove 49 has a depth that is more than about one third, preferably about half the thickness of the front portion 44*a* of the arm 44, and opposite side surfaces of the operation groove 49 are curved towards the opposite sides to substantially conform to the outer shape of the arm 44 (see FIG. 1). The locking projection 27 of the terminal fitting 10 inserted into the cavity 31 enters the operation groove 49, and an extended locking surface 51 is formed at the rear end of the operation groove 49 substantially continuous with the locking surface 48 of the fastening projection 45 for engaging the locking projection 27. This extended locking surface 51 is inclined to be more backward than the locking surface 48 towards the bottom end and has an inclination that substantially conforms with the front cut end surface 21*a* of the cut-away portion 21 of the terminal fitting 10. A jig insertion groove 52 is formed in the front end of the front portion 44*a* of the arm 44 and communicates with the operation groove 49 for receiving the disengagement jig. The jig insertion groove 52 longitudinally divides the front end of the front portion 44*a* of the arm 44. A guiding surface 53 is formed at the rear end of the jig insertion groove 52 and is inclined up and to the rear for guiding the disengagement jig to the operation groove 49.

A recess 54 is formed in the upper surface of the fastening projection 45, which is a surface against which the locking projection 27 slides during insertion of the terminal fitting 10. The recess 54 is substantially in the widthwise middle of the fastening projection 45 and defines an extension of the protrusion insertion groove 37. The recess 54 is narrower than the protrusion insertion groove 37 and is substantially as wide as the locking projection 27. The depth of the recess 54 is less than about half, preferably about ⅓ of the depth of the protrusion insertion groove 37 and the height of the locking projection 27. Accordingly, about ⅓ of the projecting end of the locking projection 27 enters the recess 54 during insertion of the terminal fitting 10, and the arcuate surfaces 28*a*, 29*a* of the outer surface of the locking projection 27 slide in contact with a bottom surface 54*a* of the recess 54. The bottom surface 54*a* of the recess 54 is arcuate and substantially conforms with the shape of the arcuate surface 29*a* of the rear portion 29 of the locking projection 27. Thus, the arcuate surface 29*a* of the locking projection 27 slides in contact with the bottom surface 54*a* of the recess 54 over substantially the entire width, during insertion of the terminal fitting 10, and almost no clearance is defined between the surfaces 29*a* and 54*a*.

The retainer 42 is mounted at the partial locking position in the housing 30, and the terminal fittings 10 crimped, bent or folded into connection with the wires W are inserted into the cavities 31, as shown in FIG. 6. An attempt could made to insert the terminal fitting 10 in an improper posture, i.e. upside-down posture where the stabilizer 26. However, the front end surface of the stabilizer 26 will contact the preventing portion 40 at the peripheral edge of the rear end of the cavity 31, thereby preventing insertion of the terminal fitting 10. In this way, improper insertion of the terminal fitting 10 is prevented.

Figure 7:
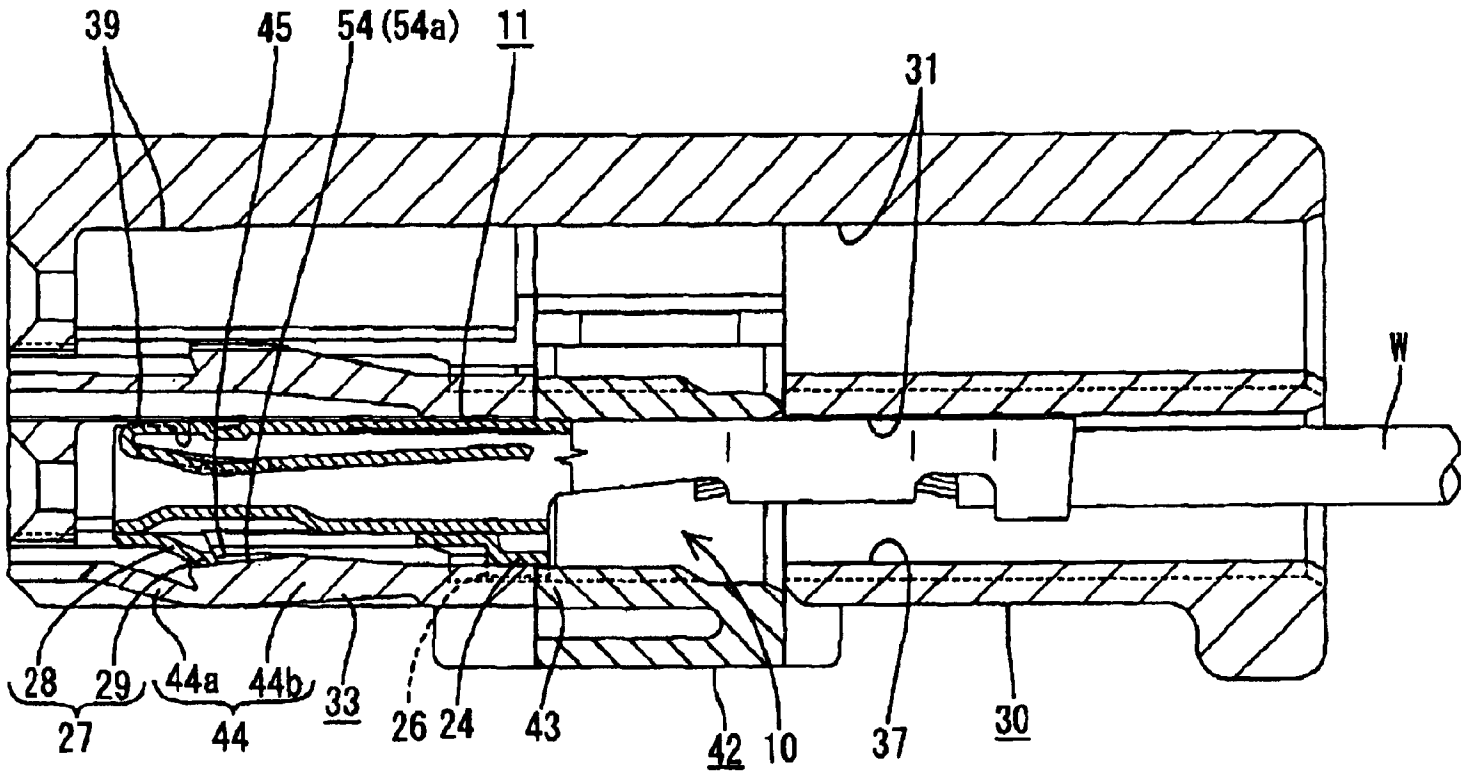
FIG. 7 is a side view in section showing an intermediate state of inserting the terminal fitting into the housing.

The properly oriented terminal fitting 10 can be inserted into the cavity 31. As a result, the locking projection 27 and the protrusion 24 sequentially enter the protrusion insertion groove 37. Additionally, the stabilizer 26 enters the stabilizer insertion groove 38. Thus, the terminal fitting 10 can be inserted smoothly without making transverse shaking movements. The locking projection 27 moves onto the fastening projection 45 when the terminal fitting 10 is inserted to a specified depth. Thus, the locking projection 27 enters the recess 54 and presses the fastening projection 45 down in the deflection direction, thereby resiliently deforming the lock 33, as shown in FIG. 7. The deformation of the lock 33 causes the arm 44 to take a flat V- or inverted bridge-shape when being viewed sideways, so that the front portion 44*a* is inclined backward and the rear portion 44*b* is inclined forward.

Figure 8:
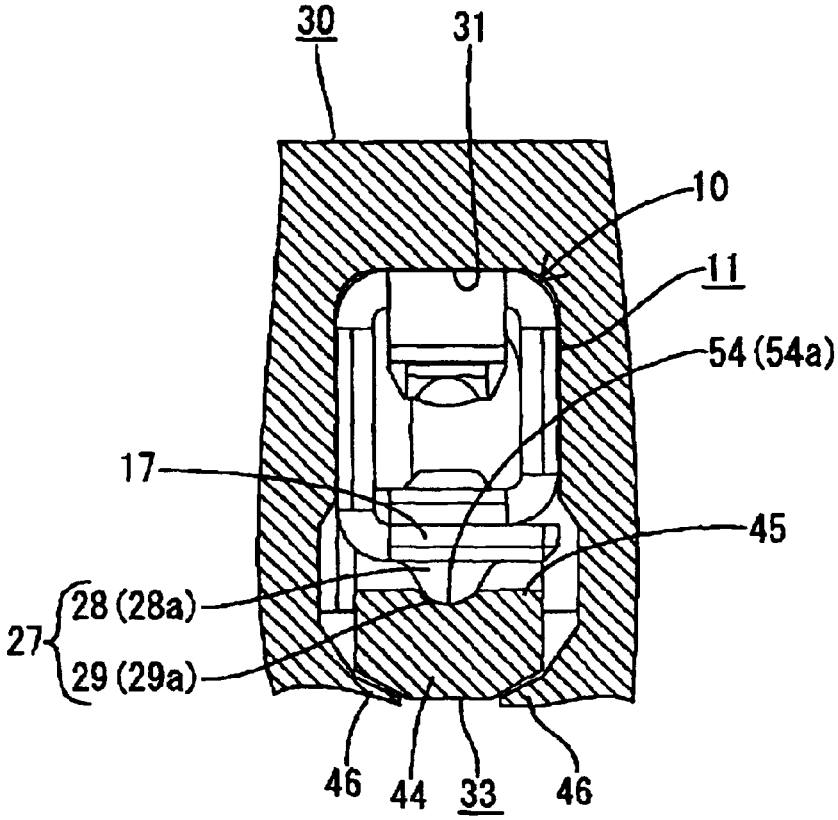
FIG. 8 is a front view in section showing the state of FIG. 7.
Figure 9:
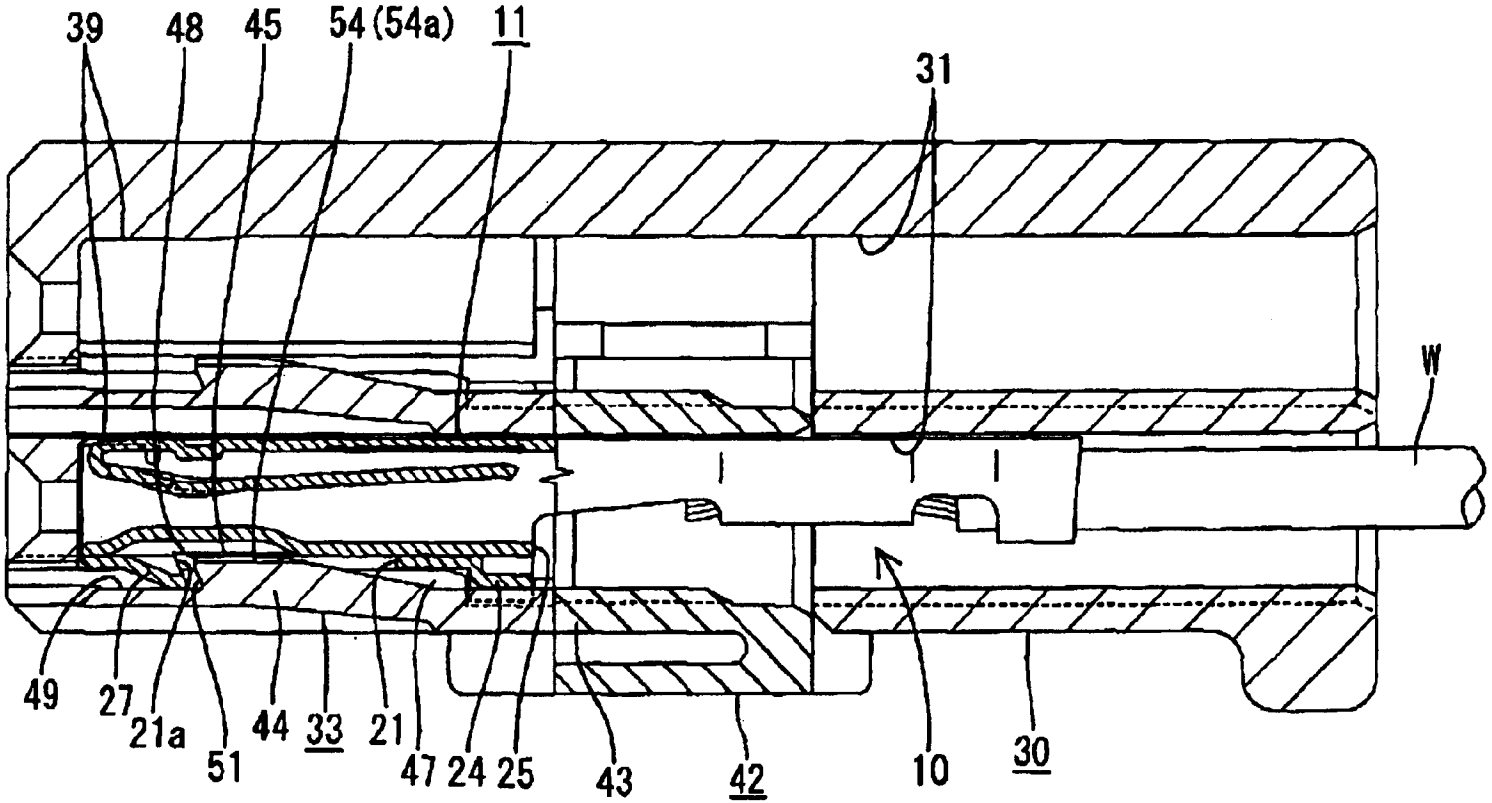
FIG. 9 is a side view in section showing a state where the terminal fitting is properly inserted in the housing.

The front portion 28 of the locking projection 27 enters the recess 54 first during the insertion process and the arcuate surface 28*a* thereof slides in contact with the bottom surface 54*a*. The front portion 28 has a slanted substantially semiconical shape with a height that gradually increases towards the rear portion 29. Thus, the lock 33 is deformed gradually, and the inserting movement smooth. The projecting end of the rear portion 29 enters the recess 54 after the front portion 28, and the arcuate surface 29*a* slides in contact with the bottom surface 54*b* of the recess 54, as shown in FIG. 8. At this time, the lock 33 undergoes a maximum resilient deformation. However, the arcuate surface 29*a* of the rear portion 29 is in sliding contact with the bottom surface 54*a* of the recess 54 over substantially the entire width, and almost no clearance is defined between the two surfaces 29*a* and 54*a*. If the outer surface of the locking projection 27 bulged out more downward than the bottom surface 54*a* of the recess 54, only the bulged-out portion would slide in contact with the bottom surface 54*a* of the recess 54. Thus, a clearance would be defined between the two surfaces, and the required deformation of the lock 33 would be increased by as much as this clearance. However, the degree of resilient deformation of the lock 33 is reduced maximally in this embodiment due to the surface-to-surface sliding contact between the surfaces 29*a* and 54*a*. As a result, an inserting force for the terminal fitting 10 is low, and the deformation space for the lock 33 is small. Therefore, the connector can be miniaturized.

There are cases where an operator misunderstands that the terminal fittings 10 have reached a proper depth although one or some of them are inserted insufficiently and moves the retainer 42 to the full locking position. In such cases, the fastening portion 43 of the retainer 42 contacts the bottom surface of the main portion 11 of the insufficiently inserted terminal fitting 10, thereby preventing a movement of the retainer 42 to the full locking position. In this way, the insufficient insertion of the terminal fitting 10 can be detected.

The locking projection 27 moves over the fastening projection 45 of the lock 33 and enters the operation grooves 49 located before the fastening projection 45 when the terminal fitting 10 is inserted to the proper depth in the cavity 3. The lock 33 then is restored resiliently. As a result, the fastening projection 45 of the lock 33 enters the cut-away portion 21 and the locking surface 48 and the extended locking surface 51 engage the front cut end surface 21*a* (including the rear end surface of the locking projection 27) of the cut-away portion 21. Thus, the lock 33 holds the terminal fitting 10 with a sufficient locking force. The bulge 39 on the ceiling of the cavity 31 pushes the front end of the main portion 11 down towards the lock 33 in the process of inserting the terminal fitting 10. Thus, a depth of engagement of the lock 33 with the terminal fitting 10 becomes even larger. The locking surface 48 of the lock 33 is formed over substantially the entire width of the lock 33, i.e. in a width area corresponding to the width of the cavity 31, and the front cut end surface 21*a* of the cut-away portion 21 of the terminal fitting 10 is formed over substantially the entire width of the terminal fitting 10. Thus, the terminal fitting 10 is held with a strong locking force. Further, the front cut end surface 21*a* of the cut-away portion 21 is overhanging or undercut and the extended locking surface 51 is a slanted surface with substantially the same inclination as the front cut end surface 21*a*. Hence, the locking force is even stronger.

Figure 10:
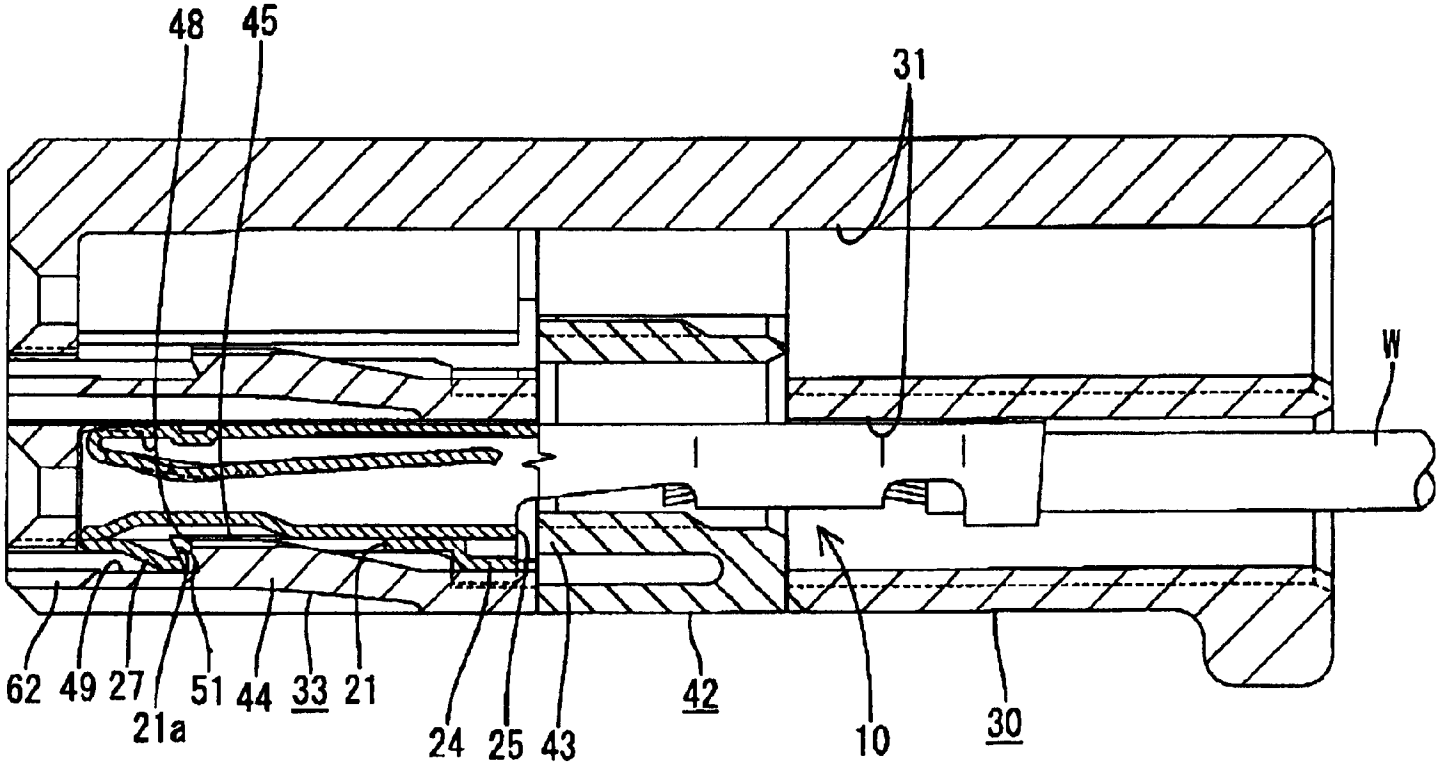
FIG. 10 is a side view in section showing a state attained after moving the retainer to a full locking position.

The retainer 42 is moved to the full locking position, as shown in FIG. 10, after all the terminal fittings 10 are inserted into the corresponding cavities 31. Thus, the fastening portions 43 enter the corresponding cavities 31 to engage the stepped portions 25 including the protrusions 24. In this way, the terminal fittings 10 are held so as not to come out of the cavities 31 and are locked doubly by the locks 33 and the retainer 42. In the case of withdrawing the terminal fitting 10 for maintenance or other reason, the retainer 42 is returned to the partial locking position to cancel the locked state by the retainer 42 and then the disengagement jig is inserted into the jig insertion groove 52 and the operation groove 49. Accordingly, the bottom surface of the operation groove 49 is pressed down to deform the lock 33 in the deformation direction. The wire W can be pulled to withdraw the terminal fitting 10 from the cavity 31 after the terminal fitting 10 is freed from the locked state by the lock 33.

As described above, the outer wall 17 of the terminal fitting 10 facing the lock 33 has locking projection 27 projecting towards he lock 33, and the recess 54 is formed in the surface of the lock 33 that slides in contact with the locking projection 27 in the inserting process. Thus, the deformation of the lock 33 generated during insertion of the terminal fitting 10 is reduced by the depth of the recess 54. Further, the surfaces 29*a*, 54*a* of the locking projection 27 and the recess 54 have substantially conforming curved shapes and are held in substantially surface-to-surface sliding contact with each other. As a result, the degree of deformation of the lock 33 is reduced maximally.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the depth of the recess is about ⅓ of the height of the locking projection in the foregoing embodiment, it can be set arbitrarily set.

The surfaces of the locking projection and the recess to be held substantially in sliding contact are arcuate in the foregoing embodiment. However, they may be, for example, angular or polygonal surfaces.

The outer wall of the terminal fitting is divided into the front and rear portions by the cut-away portion in the foregoing embodiment. However, the cut-away portion may be formed, for example, in a width range smaller than the width of the outer wall and the projecting ends of the front and rear portions of the outer wall may be coupled by at least one coupling according to the present invention. Further, the cut-away portion may be omitted and, in such a case, the lock may be engaged, for example, with the stepped portion and the protrusion of the main portion. In such a case, the bottom surface of the recess may have such a shape substantially in conformity with the outer surface of the protrusion.

Besides the foregoing embodiment, the cut-away portion and the locking projection may be formed in any one of the sidewalls and the bottom wall of the main portion and the lock may be engaged therewith.

Although the lock is supported at both ends in the foregoing embodiment, the present invention is also applicable to connectors provided with cantilevered locks supported at one end.

Although the female connector is shown in the foregoing embodiment, the present invention is also applicable to male connectors into which male terminal fittings provided with tabs are insertable.

What is claimed is:

1. A connector with a housing having opposite front and rear ends and a cavity extending between the ends, a lock provided in the cavity, the lock being temporarily resiliently deformed by insertion of a terminal fitting into the cavity along an inserting direction from the rear towards the front of the housing, and the lock being resiliently restored to engage the terminal fitting when the terminal fitting reaches a proper depth, thereby preventing the terminal fitting from coming out, wherein:

an outer wall of the terminal fitting substantially facing the lock has a locking projection projecting towards and engageable with the lock, the locking projection being arcuate in a transverse direction aligned transverse to the inserting direction, a recess is formed in a surface of the lock for sliding contact with the locking projection, the recess being arcuate in the transverse direction and being elongated along the inserting direction, and sliding-contact surfaces of the locking projection and the recess have substantially conforming shapes in the transverse direction for minimizing a required resilient deformation of the lock during insertion of the terminal fitting into the cavity.

2. The connector of claim 1, wherein the locking projection comprises a slanted substantially semiconical front portion.

3. The connector of claim 1, wherein the lock is substantially transversely symmetrical.

4. The connector of claim 1, further comprising at least one excessive deformation preventing portion disposed for engaging the lock before the lock is deformed beyond its resiliency limit.

5. The connector of claim 1, wherein the lock comprises an arm that is resiliently deformable about at least one end.

6. The connector of claim 5, wherein the arm and the cavity have substantially equal widths.

7. The connector of claim 1, wherein the outer wall of the terminal fitting is embossed in an intermediate position to form a protrusion, and wherein the cavity has a protrusion insertion groove for receiving the protrusion.

8. The connector according to claim 7, wherein the recess is narrower than the protrusion insertion groove and substantially as wide as the locking projection, and the recess is less than about half as deep as the protrusion insertion groove.

9. A connector with a housing having a cavity and a lock provided in the cavity, the lock being temporarily resiliently deformed by insertion of a terminal fitting into the cavity, and the lock being resiliently restored to engage the terminal fitting when the terminal fitting reaches a proper depth, thereby preventing the terminal fitting from coming out, wherein:

an outer wall of the terminal fitting substantially facing the lock has a locking projection projecting towards and engageable with the lock, a recess is formed in a surface of the lock for sliding contact with the locking projection, and sliding-contact surfaces of the locking projection and the recess have substantially conforming shapes, wherein the locking projection comprises a rear portion having a surface disposed for sliding contact with a bottom surface of the recess over substantially an entire width thereof, so that almost no clearance is defined between the two surfaces.

10. A connector with a housing having a cavity and a lock provided in the cavity, the lock being temporarily resiliently deformed by insertion of a terminal fitting into the cavity, and the lock being resiliently restored to engage the terminal fitting when the terminal fitting reaches a proper death, thereby preventing the terminal fitting from coming out, wherein:

an outer wall of the terminal fitting substantially facing the lock has a locking projection projecting towards and engageable with the lock, a recess is formed in a surface of the lock for sliding contact with the locking projection, and sliding-contact surfaces of the locking projection and the recess have substantially conforming shapes, the lock comprises a fastening projection for engaging and locking the terminal fitting, the fastening projection having a locking surface inclined to overhang, an operation groove in front of the lock and an extended locking surface is substantially continuous with a rear end of the locking surface of the fastening projection and engageable with the locking projection, wherein the locking projection of the terminal fitting inserted into the cavity can enter the operation groove in front of the lock.

11. The connector of claim 10, wherein an engagement surface of the locking projection is an overhanging surface and the extended locking surface is a slanted surface having substantially the same inclination as the engagement surface.

* * * * *